United States Patent [19]

Valentino

[11] Patent Number: 4,869,005

[45] Date of Patent: Sep. 26, 1989

[54] NOVELTY DEVICE FOR VIEWING OUTDOOR SCENES

[76] Inventor: George Valentino, 257-09 149 Rd., Rosedale, N.Y. 11422

[21] Appl. No.: 68,665

[22] Filed: Jul. 1, 1987

[51] Int. Cl.[4] ..... G09F 19/00

[52] U.S. Cl. ..... 40/406; 40/410; 40/411

[58] Field of Search ..... 40/406, 407, 409, 410, 40/411, 421, 416, 418, 419, 420

[56] References Cited

U.S. PATENT DOCUMENTS

| | | | |
|---|---|---|---|
| 367,899 | 8/1887 | Ecker | 40/160 |
| 1,627,270 | 5/1927 | Burnham | 40/409 |
| 2,361,423 | 10/1944 | Snyder | 40/406 |
| 2,791,998 | 5/1957 | Decker | 40/421 |
| 2,814,895 | 12/1957 | Flam | 40/160 |
| 3,121,417 | 2/1964 | Goldman et al. | 40/160 |
| 3,236,368 | 2/1966 | Eisen | 428/13 |
| 3,318,040 | 5/1967 | Kinberg | 40/421 |
| 3,333,358 | 8/1967 | Green et al. | 40/160 |
| 3,494,614 | 2/1970 | Taylor | 40/410 |
| 3,503,147 | 3/1970 | Herrin et al. | 40/160 |
| 4,521,982 | 6/1985 | Altuchow | 40/406 |

*Primary Examiner*—John J. Wilson

*Attorney, Agent, or Firm*—Gerard F. Dunne

[57] ABSTRACT

A novelty device for representing an outdoor scene includes an outer portion configured to resemble the interior of a room and having an opening which may represent a door or a window for viewing the outdoor scene. An inner portion is positioned behind this opening, and the inner portion contains artwork representing the outdoor scene and a fluid containing particles adapted to be spread throughout the fluid. In this way, the inner portion can be shaken to spread the particles throughout the fluid so that they may settle by gravity to resemble falling objects such as snow or autumn leaves traditionally found in the outdoors. The inner piece may be divided into two compartments which represent different seasons of the same outdoor scene and, in this way, the inner piece can be removed with either of its scenes positioned behind the opening to illustrate either of two outdoor scenes.

5 Claims, 3 Drawing Sheets

NOVELTY DEVICE FOR VIEWING OUTDOOR SCENES

The present invention relates to a novelty device which includes a transparent container having artwork representing an outdoor scene and filled with a fluid containing particles which can be spread throughout the fluid medium upon shaking to later settle and resemble such items as falling snow or falling leaves.

Objects of this general type are known, and traditionally include a transparent globe housing a fluid medium and statuettes or artwork representing an outdoor scene. Particles representing such items as snow are adapted to be spread throughout the fluid medium upon shaking the transparent globe. These particles may then settle to resemble snow falling in an outdoor environment. These traditional objects generally represent outdoor scenes only, and is an important feature of the present invention to provide a device which represents a room interior having an opening such as a window or door for viewing the outdoors. In this way, a novelty device can be created with an indoor scene of infinite variety, and the indoor scene could include well-known characters to enhance the attractiveness of the device.

Additionally, the inner piece of the novelty device can be divided into two separate compartments which can be placed alternatively behind the openings so that the user may select either of two outdoor scene for viewing through the opening.

According to the present invention, a novelty device for representing a scene includes an outer portion configured to resemble the interior of a room having an opening such as a window or door for viewing the outdoors. An inner portion is positioned behind the opening of the outer portion, and this inner portion contains artwork resembling an outdoor scene as well as a fluid with particles immersed therein which are adapted to be spread throughout the fluid upon shaking the inner portion. In this way, the inner portion can be shaken to spread the particles throughout the fluid so that they settle by gravity to resemble falling objects such as snow or autumn leaves traditionally found in the outdoors.

It is also proposed that the inner portion may be held removably within the outer portion, and the inner portion may have a front and back compartment each representing the same outdoor scene in a respective season. For example, one compartment may represent the same scene with the suspended particles representing snow, whereas the second compartment may represent the scene with the suspended particles representing falling leaves. In this way, the inner piece may be removed from the outer piece and either of the two compartments selected to represent either an autumn or winter scene as desired.

These an other important features and advantages of the present invention will become more apparent from a review of the following detailed description made in conjunction with the following drawings in which.

Figure 1:
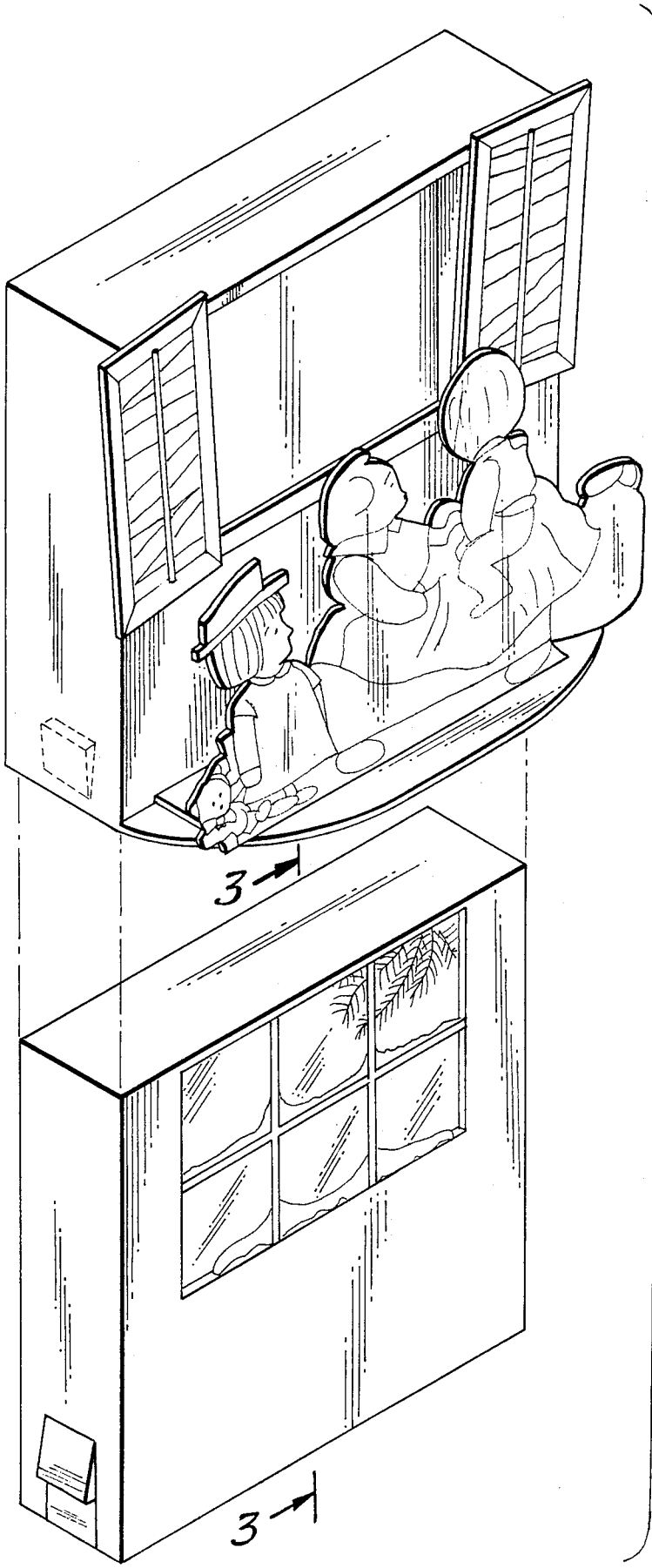
FIG. 1 is an exploded view of the inner and outer portions of an embodiment of the present invention.
Figure 2:
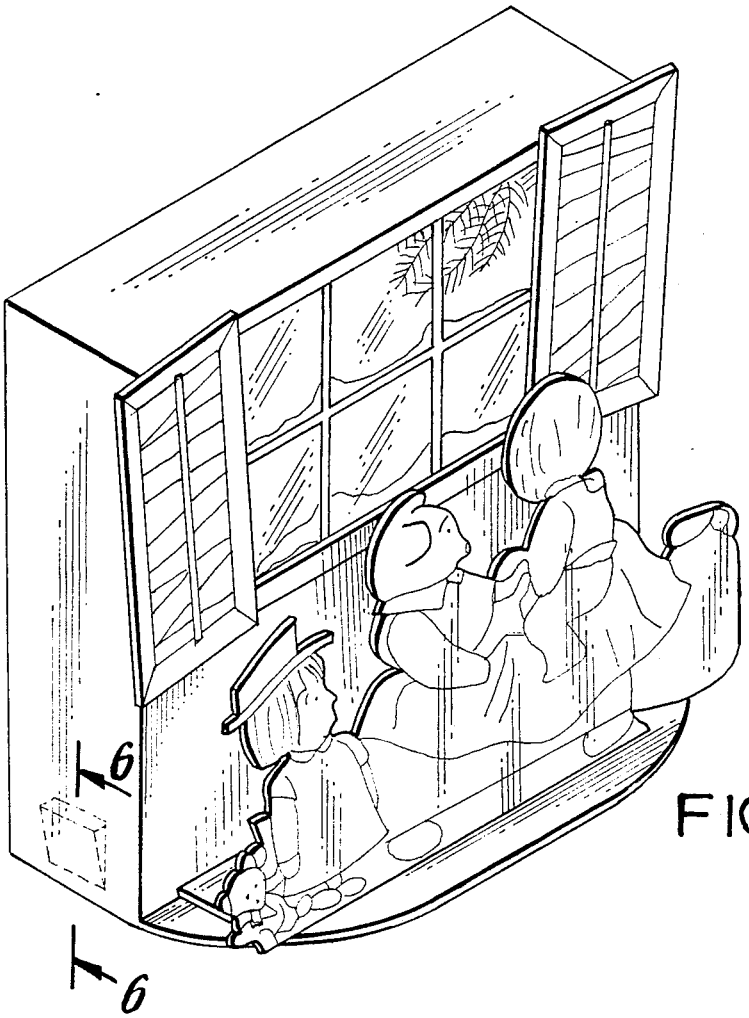
FIG. 2 shows the invention of FIG. 1 in its assembled condition.

As illustrated in FIG. 1, an outer portion 10 illustrates an interior scene which may have characters 12 which can be formed by artwork applied to wall portion 14, or shown, by statuettes spaced from wall portion 14 or as a relief pattern. These characters may be well-known and easily recognized characters which can be made highly noticeable to enhance the attractiveness of the device of the present invention.

The wall portion 14 includes an opening 16 illustrated as a window having shutter elements 18, but is understood that the opening of the present invention may alternatively represent a door opening towards the outside of the room interior.

The outer portion 10 is hollow and has an open bottom, and as illustrated in FIG. 1, and inner portion 30 is configured to be slid within the interior of the outer portion 10. The inner portion 30 includes artwork representing details of the opening 16 such as window panes 32 and perhaps portions of an outdoor scene such as tree limbs 33. The portion represented by the window panes 32 is transparent, and housed within the inner portion 30 is a fluid medium having particles dispersed therein which may be spread throughout the fluid medium upon shaking the inner portion 30. Preferably, these particles would then be able to settle by gravity to represent falling objects traditionally found in an outdoor scene, such as falling snow or autumn leaves. In this way, it is understood that the inner portion could be shaken to disperse the particles throughout the fluid medium, and the inner portion can be slid within the outer piece to represent an outdoor scene having falling snow or autumn leaves. It should be understood that the inner portion 30 may include statuettes depicting characters, trees, shrubbery or the like, and the falling particles resembling leaves or snow would then be able to fall upon these initial structures.

Figure 3:
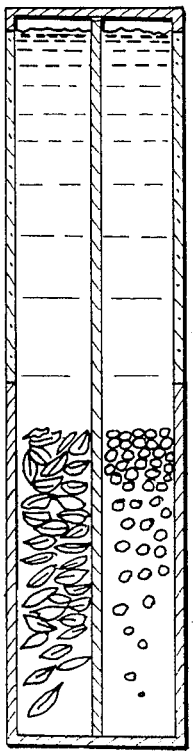
FIG. 3 is a cross section through the inner portion 30 of FIG. 1.

As illustrated in FIG. 3, the inner portion 30 is divided into two compartments including a front compartment 34 and a rear compartment 36. Each compartment is separated by a central partition 38, and includes differing particles such as those labelled at 40 to represent snow flakes and those labelled at 42 to represent autumn leaves.

Figure 6:
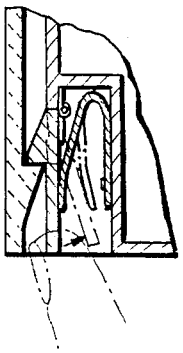
FIG. 6 is a detailed view of the release mechanism used to hold the inner portion 30 within the outer portion 10.

The inner portion 30 includes on the lower portion of each of its side walls a depressible cam 44 which is hinged resiliently to the side wall portion. As illustrated in FIG. 6, a standard hinge 46 can be supplied to hinge the depressible cam 44 to the side wall portions of the inner piece, and a resilient spring element 48 may be provided to urge the depressable cam portion outwardly. As illustrated in FIG. 6, the inner side walls of the outer portion include a camming element 50 which serves to urge the depressible cam 44 inwardly upon insertion of the inner portion into its locking position; whereupon the spring 48 will serve to resiliently flex the depressible cam 44 outwardly to latch the inner portion within the outer portion as shown FIG. 6.

It is understood other mechanical structures could be provided for removably securing the inner portion within the outer portion, and these structures of FIG. 6 are provided by way of illustration.

Figure 4:
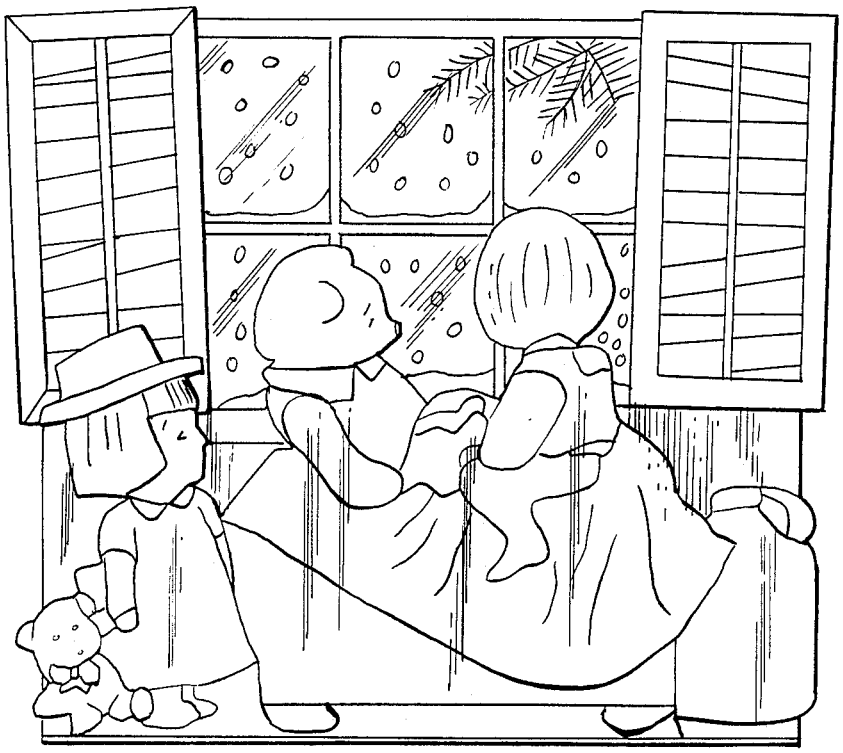
FIG. 4 is a front elevational view of the device of FIG. 1 illustrating one of the two compartments of the inner portion illustrating a winter scene.
Figure 5:
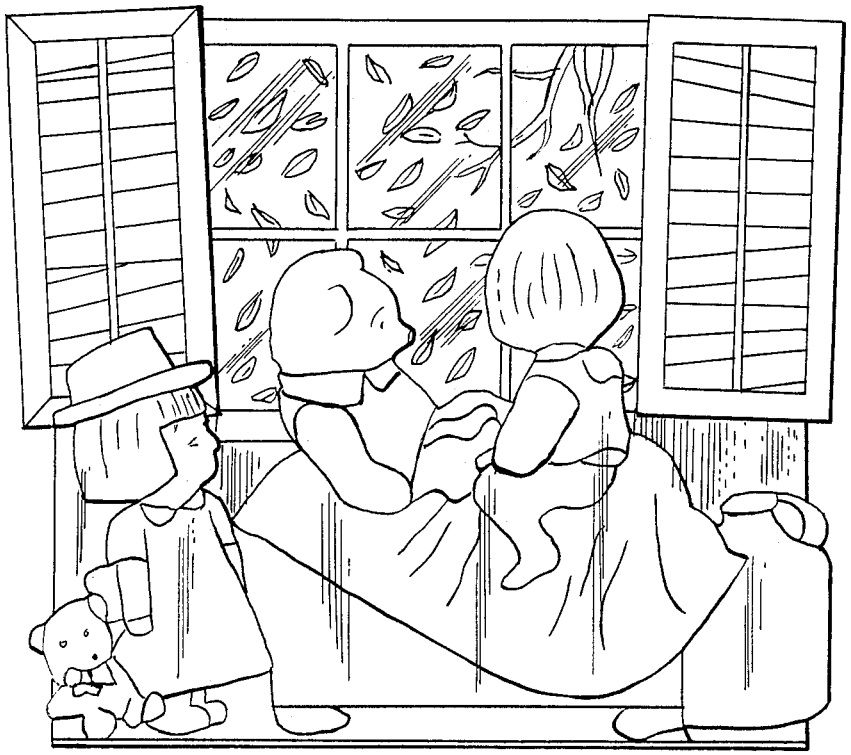
FIG. 5 is a front elevational view of the device of FIG. 1 illustrating one of the two compartments of the inner portion illustrating an autumn scene.

It could be understood, therefore, that the inner portion 30 can be removed from the outer portion 10 to insert either the front compartment 34 behind the window opening 16 as illustrated in FIG. 4 to represent an outdoor winter scene having falling snow; or the inner portion can be positioned to locate the back compartment 36 behind the window opening 16 to illustrate an autumn scene having falling leaves as illustrated in FIG. 5. In this way, the user can alter the outdoor scene used by the device according to choice.

The embodiment described above is intended to illustrated a preferred embodiment of the present invention; and is not to be considered limiting anyway to the scope of my invention which is defined the appended claim.

I claim:

1. A novelty device for representing a scene, including an outer portion configured to resemble the interior of a room having an opening for viewing the outdoors, and an inner portion position behind said opening, said inner portion containing artwork resembling an outdoor scene, a fluid contained in said inner portion, and particles immersed in said fluid, said particles being adapted to be spread through said fluid whereby upon shaking said inner portion said particles can be made to spread throughout said fluid and be caused to settle by gravity to resemble falling objects traditionally found in the outdoors, said inner portion being held removably in said outer portion, said inner portion having a front and back compartment each representing the same outdoor scene in a respective season whereby said inner portion may be inserted in said outer portion with either of said compartments facing said opening.

2. A novelty device as set forth in claim 1, said front and back compartments having particles representing snow and falling leaves respectively to represent either a winter or autumn scene through said opening.

3. A novelty device including an outer portion having an opening for viewing a scene, and an inner portion position behind said opening, said inner portion containing artwork resembling said scene, said outer portion having artwork thereon to form a common scene with the artwork on said inner portion, a fluid contained in said inner portion and particles immersed in said fluid, said particles being adapted to spread through said fluid whereby upon shaking said inner portion said particles can be made to spread throughout said fluid and be caused to settle by gravity to resemble falling objects, said inner portion being held removably in said outer portion.

4. A portable novelty device for representing a scene, including an outer portion configured to resemble the interior of a room having an opening for viewing the outdoors, and a removable inner portion position behind said opening, said inner portion containing artwork resembling an outdoor scene, said inner portion having a front and back compartment each representing the same outdoor scene in a respective season whereby said inner portion may be inserted in said outer portion with either of said compartments facing said opening, and means carried by said inner portion for animating said outdoor scene.

5. A novelty device as set forth in claim 6, said means including a fluid and particles immersed in said fluid, said particles being adapted to be spread through said fluid whereby upon shaking said inner portion said particles can be made to spread throughout said fluid and be caused to settle by gravity to resemble falling objects traditionally found in the outdoors.

* * * * *